US011351589B2

(12) United States Patent
Tsai et al.

(10) Patent No.: US 11,351,589 B2
(45) Date of Patent: Jun. 7, 2022

(54) SHEET METAL HEMMING DEVICE

(71) Applicant: INDUSTRIAL TECHNOLOGY RESEARCH INSTITUTE, Hsinchu (TW)

(72) Inventors: De-Ru Tsai, Taipei (TW); Yuan-Chieh Lo, Taichung (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 0 days.

(21) Appl. No.: 17/149,027

(22) Filed: Jan. 14, 2021

(65) Prior Publication Data

US 2022/0143669 A1 May 12, 2022

(30) Foreign Application Priority Data

Nov. 10, 2020 (TW) ..... 109139166

(51) Int. Cl.
*B21D 19/04* (2006.01)

(52) U.S. Cl.
CPC ..... *B21D 19/043* (2013.01)

(58) Field of Classification Search
CPC ..... B21D 19/043; B21D 19/02; B21D 19/00; B21D 39/02; B21D 39/023; B21D 39/021
See application file for complete search history.

(56) References Cited

U.S. PATENT DOCUMENTS 7,290,423 B2 11/2007 Carsley et al.
7,500,373 B2 3/2009 Quell
7,637,134 B2 12/2009 Burzlaff et al.
7,870,774 B2 * 1/2011 Hasegawa ..... B21D 39/023 72/220
8,914,964 B2 12/2014 Hasegawa et al.
9,573,318 B2 2/2017 Lee
(Continued)

FOREIGN PATENT DOCUMENTS

CN 101817042 A 9/2010
CN 103302154 A 9/2013
(Continued)

OTHER PUBLICATIONS

Esquivel et al., "A Dynamic Compensation for Roll Hemming Process", IEEE Access, vol. 6, 2018, pp. 18264-18275.
(Continued)

*Primary Examiner* — Teresa M Ekiert
(74) *Attorney, Agent, or Firm* — Birch, Stewart, Kolasch & Birch, LLP

(57) ABSTRACT

A sheet metal hemming device is provided. The sheet metal hemming device includes a frame and a rolling wheel, a bearing wheel, a first rotating shaft, a second rotating shaft, a sliding block, an arc-shaped guide rail and a driver which are disposed on the frame. The rolling wheel is disposed on the first rotating shaft, the bearing wheel is disposed on the second rotating shaft, and an angle is formed between the rolling wheel and the bearing wheel. The sliding block is slidable relative to the arc-shaped guide rail and is connected to the rolling wheel via the first rotating shaft. The driver is connected to the sliding block for driving the sliding block to slide along the arc-shaped guide rail to adjust the angle between the rolling wheel and the bearing wheel.

9 Claims, 7 Drawing Sheets

(56) References Cited

U.S. PATENT DOCUMENTS

| | | | | |
|---|---|---|---|---|
| 9,993,861 | B2 | 6/2018 | Yoon et al. | |
| 2008/0236236 | A1 | 10/2008 | Toeniskoetter | |
| 2010/0139350 | A1 | 6/2010 | Smith et al. | |
| 2010/0313621 | A1 | 12/2010 | Kumagai et al. | |
| 2016/0136709 | A1 | 5/2016 | Naderer et al. | |
| 2019/0070655 | A1* | 3/2019 | Kim | B21D 39/023 |

FOREIGN PATENT DOCUMENTS

| | | | |
|---|---|---|---|
| CN | 205032526 | U | 2/2016 |
| CN | 108235692 | A | 6/2018 |
| CN | 209829931 | U | 12/2019 |
| KR | 10-2009-0107827 | A | 10/2009 |
| TW | 338989 | U | 8/1998 |

OTHER PUBLICATIONS

Gürgen, "A parametric investigation of roller hemming operation on a curved edge part", Archives of Civil and Mechanical Engineering, vol. 19, 2019, pp. 11-19.

Saboori et al., "Introducing Fast Robot Roller Hemming Process in Automotive Industry", World Academy of Science, Engineering and Technology, vol. 34, 2009, pp. 503-506.

Suresh P M et al., "Design and Analysis of A-Frame for Roller Hemming Cell", International Journal of Applied Research & Studies, vol. II, Issue 2, Feb. 2013, pp. 1-5.

Zubeil et al., "Improved roller hemming system for high volume part production", Key Engineering Materials, vol. 473, 2011, pp. 168-175.

Taiwanese Office Action and Search Report for Taiwanese Application No. 109139166, dated Oct. 14, 2021.

* cited by examiner

SHEET METAL HEMMING DEVICE

This application claims the benefit of Taiwan application Serial No. 109139166, filed Nov. 10, 2020, the disclosure of which is incorporated by reference herein in its entirety.

TECHNICAL FIELD

The disclosure relates in general to a sheet metal hemming device, and more particularly to a device capable of adjusting the hemming angles.

BACKGROUND

When a conventional machine hems a sheet metal, the sheet metal needs to be supported by a bearing mold. Since the bearing mold incurs a high cost and is only applicable to single hemming angle and large batches instead of multiple hemming angles and small batches, the varied production methods for small batches cannot be used. Therefore, it is crucial for the industries to provide a sheet metal hemming device which is able to hem multiple hemming angles for small batches at high speed with high efficiency and low machining cost.

SUMMARY

The disclosure is directed to a sheet metal hemming device, which not only saves the conventional problems that the bearing mold needs to be replaced and the device is applicable to single hemming angle only, but further automatically adjusts the hemming angles, the contact force and a combination thereof to increase production quality according to production requirements.

According to one embodiment, a sheet metal hemming device is provided. The sheet metal hemming device includes a frame and a rolling wheel, a bearing wheel, a first rotating shaft, a second rotating shaft, a sliding block, an arc-shaped guide rail and a driver which are disposed on the frame. The rolling wheel is disposed on the first rotating shaft, the bearing wheel is disposed on the second rotating shaft, and an angle or a hemming angle is set between the rolling wheel and the bearing wheel. The sliding block is slidable relative to the arc-shaped guide rail and is connected to the rolling wheel via the first rotating shaft. The driver is connected to the sliding block for driving the sliding block to slide along the arc-shaped guide rail to adjust the angle between the rolling wheel and the bearing wheel.

The above and other aspects of the disclosure will become understood with regard to the following detailed description of the preferred but non-limiting embodiment(s). The following description is made with reference to the accompanying drawings.

Figure 1:
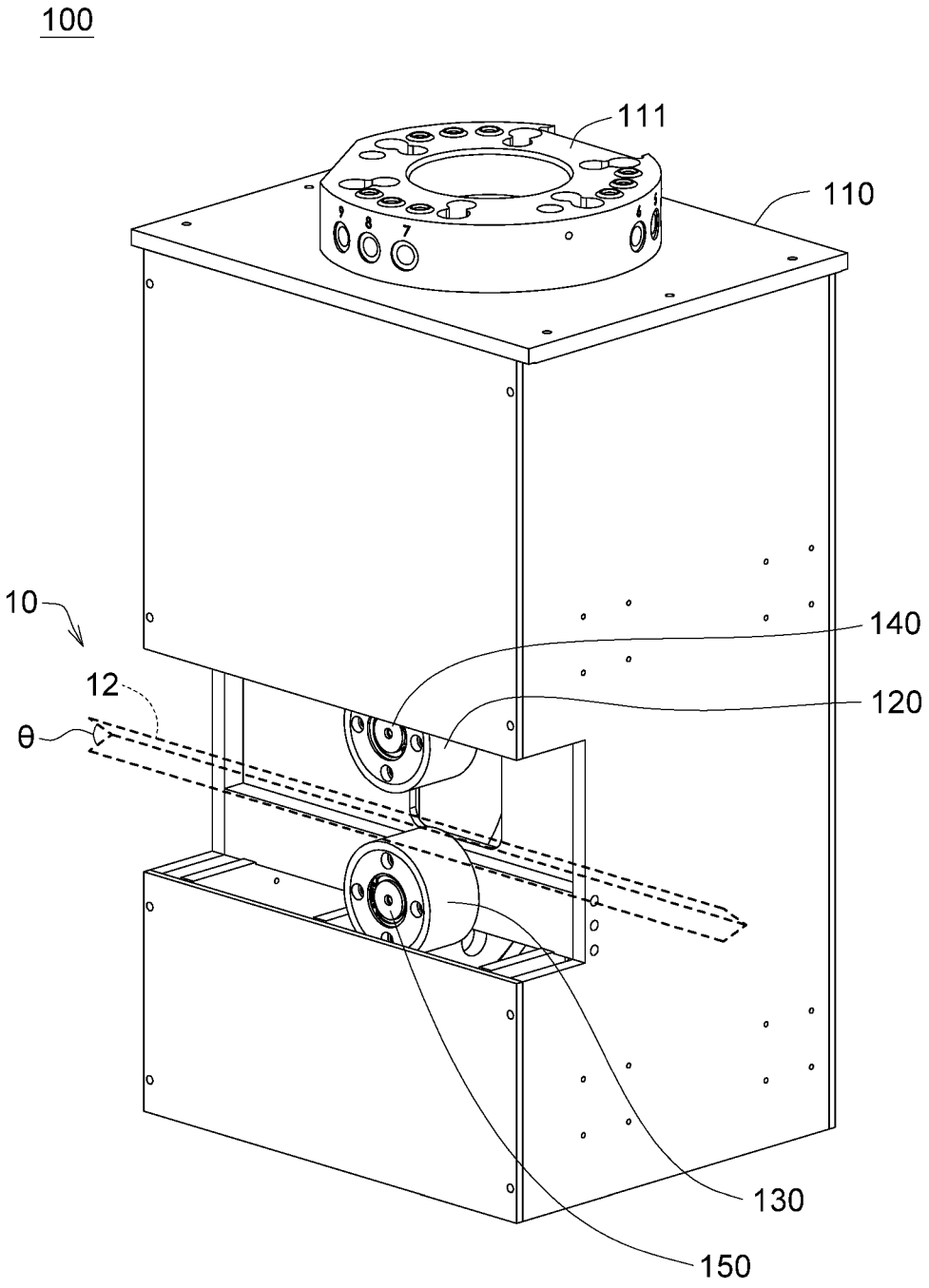
FIG. 1 is a 3D schematic diagram of a sheet metal hemming device according to an embodiment of the disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

DETAILED DESCRIPTION

Detailed descriptions of the disclosure are disclosed below with a number of embodiments. However, the disclosed embodiments are for explanatory and exemplary purposes only, not for limiting the scope of protection of the disclosure. Similar/identical designations are used to indicate similar/identical elements.

Figure 2A:
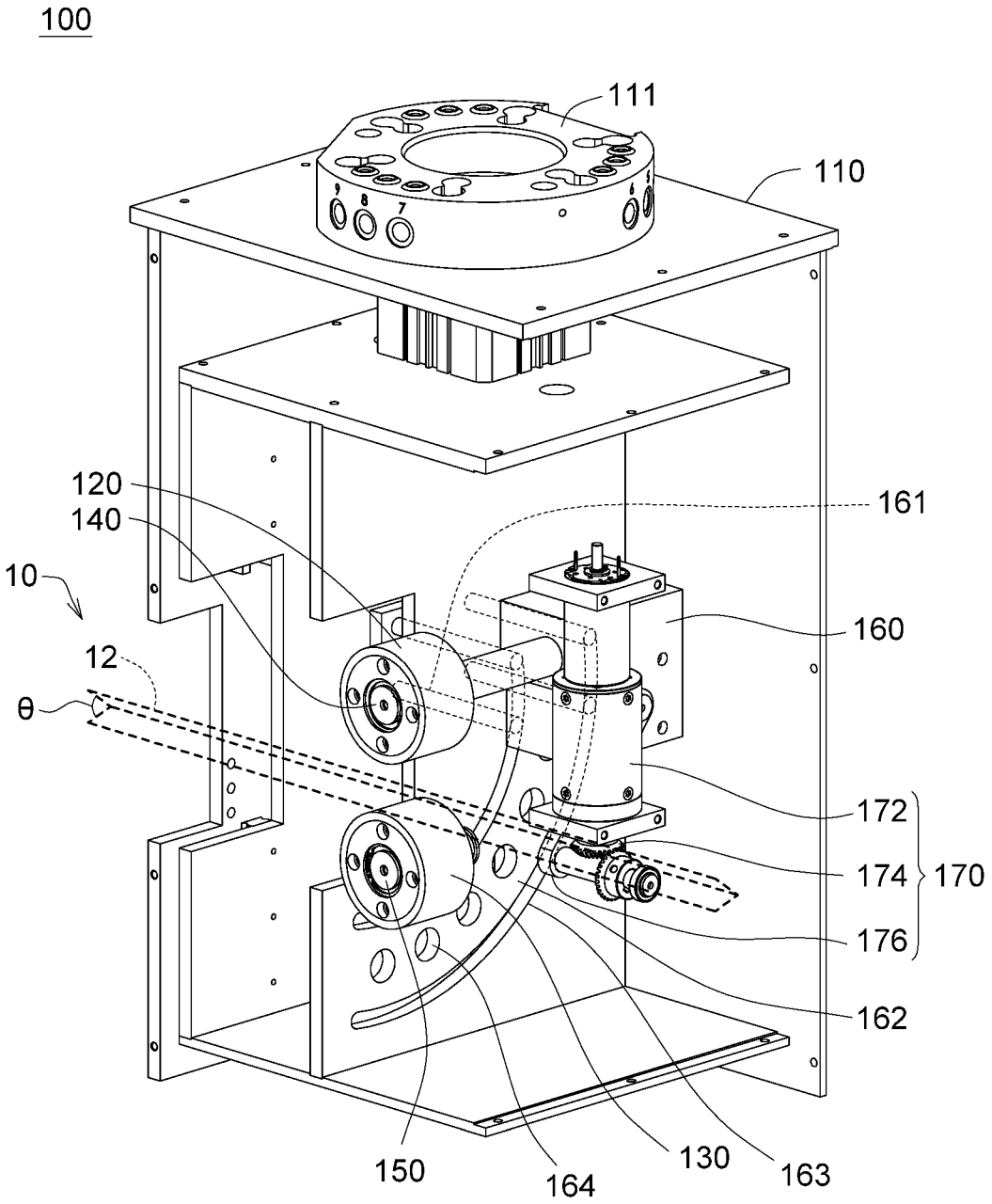
FIGS. 2A and 2B respectively are internal diagrams of the sheet metal hemming device of FIG. 1.
Figure 2B:
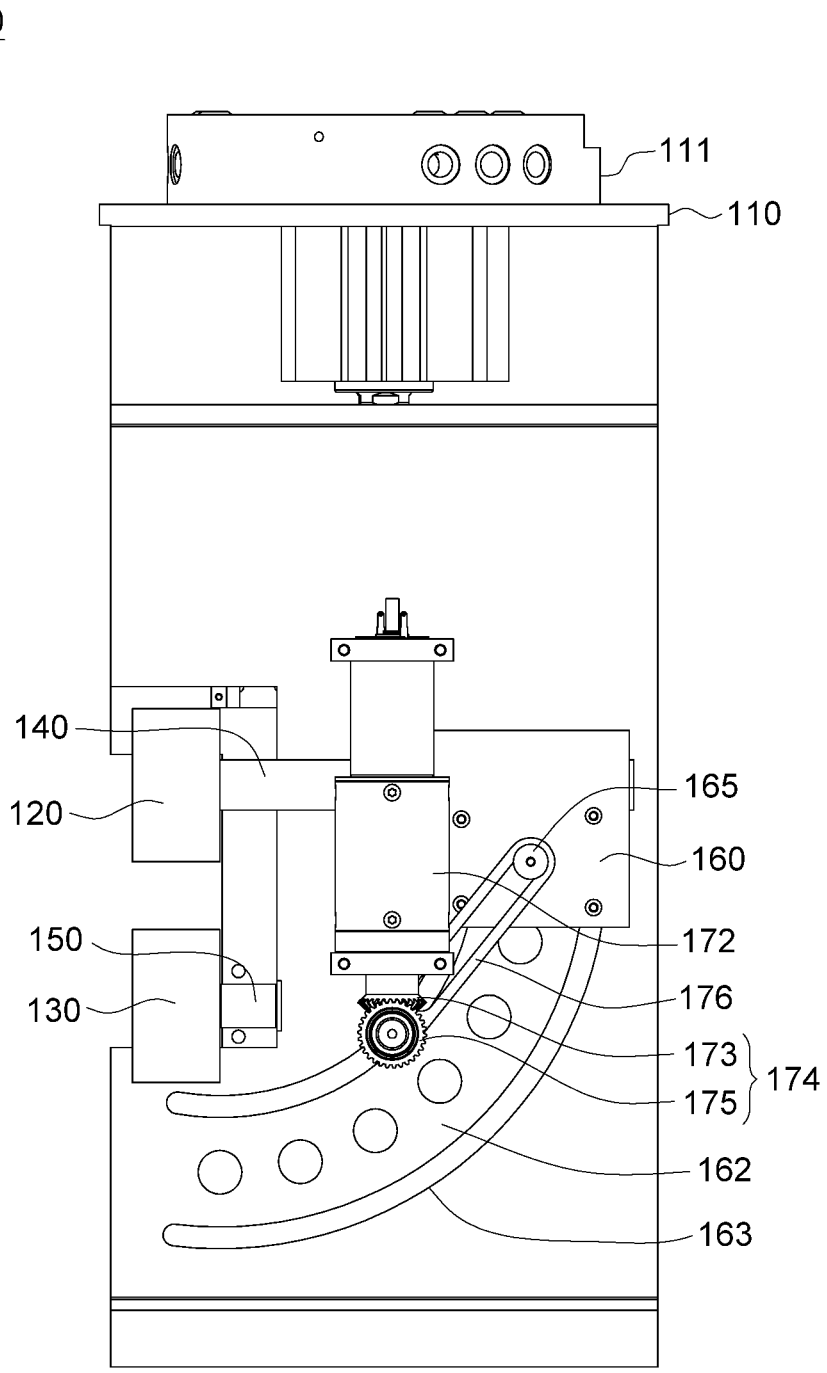

Refer to FIGS. 1, 2A and 2B. FIG. 1 is a 3D schematic diagram of a sheet metal hemming device 100 according to an embodiment of the disclosure. FIGS. 2A and 2B respectively are internal diagrams of the sheet metal hemming device 100 of FIG. 1.

According to an embodiment of the disclosure, the sheet metal hemming device 100 includes a frame 110, a rolling wheel 120, a bearing wheel 130, a first rotating shaft 140, a second rotating shaft 150, a sliding block 160, an arc-shaped guide rail 162 and a driver 170. The rolling wheel 120 and the bearing wheel 130 respectively are disposed on the first rotating shaft 140 and the second rotating shaft 150 which are located on the same side of the frame 110. A flange piece 111 is disposed on top of the frame 110. The frame 110 can be assembled to a robot arm (not illustrated in the diagram) via the flange piece 111. Through the control of the robot arm, the frame 110 can be quickly moved, rotated or turned over to a suitable angle to roll or hem a sheet metal 10. The sliding block 160 is slidable relative to the arc-shaped guide rail 162 and is connected to the rolling wheel 120 via the first rotating shaft 140. Besides, the driver 170 is connected to the sliding block 160 via the crank 176 for driving the sliding block 160 to slide along the arc-shaped guide rail 162 such that the first rotating shaft 140 is rotatable relative to the second rotating shaft 150.

In an embodiment, the rolling wheel 120 is located atop of the sheet metal 10 for applying an external force on the sheet metal 10, and the bearing wheel 130 is located under the sheet metal 10 to support the sheet metal 10, such that the sheet metal 10 can be rolled between the rolling wheel 120 and the bearing wheel 130. The sheet metal 10 can be a steel plate, a galvanized plate, a copper plate or an aluminum plate. After the sheet metal 10 is cut, stamping molded, cold rolled, hot rolled, welded, riveted and splicing molded, the sheet metal 10 can be used as a sheet metal parts of a computer case, a vehicle shell, an equipment shell, an electric control box or a protective cover.

Figure 3A:
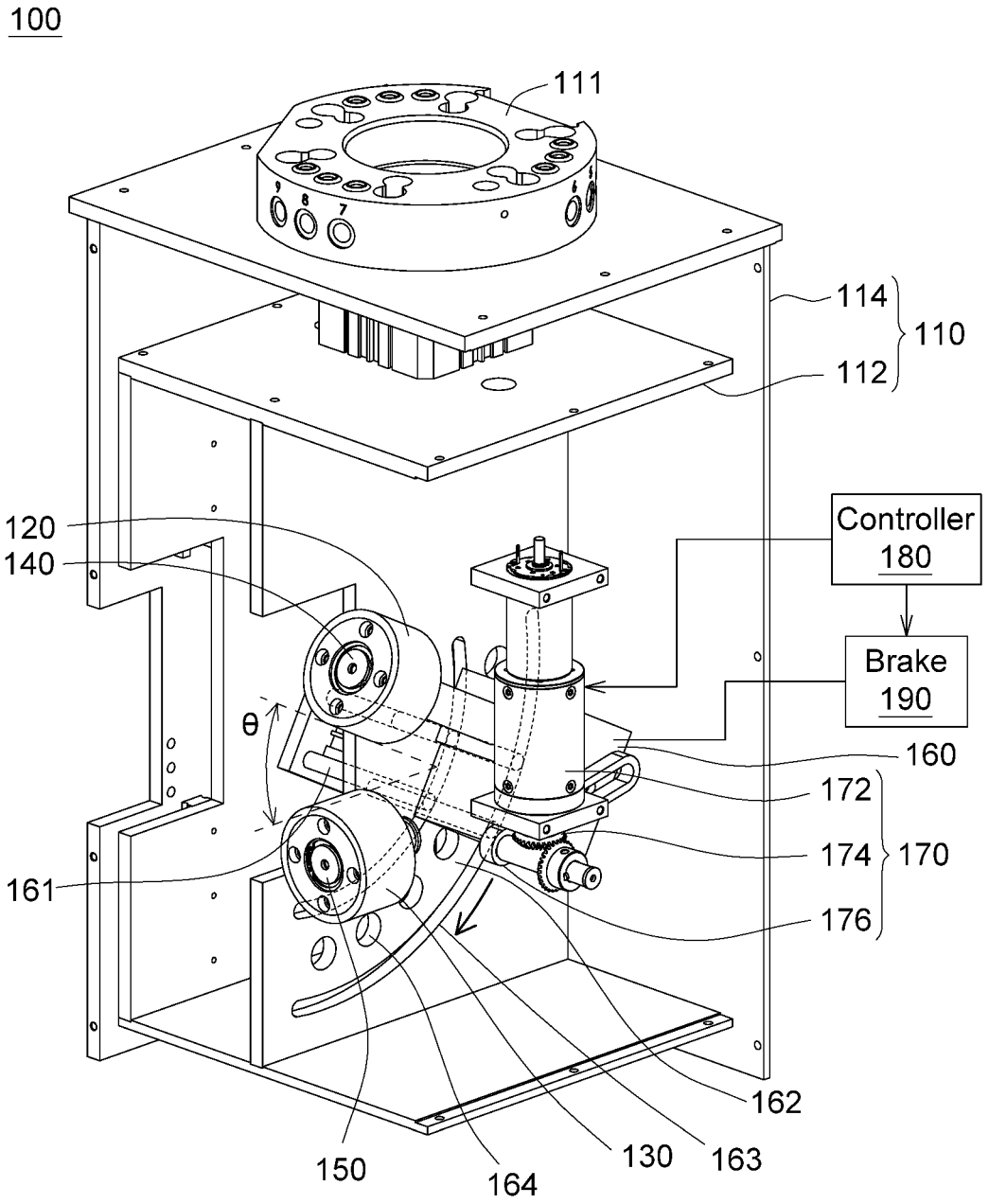
FIG. 3A is a schematic diagram of a sheet metal hemming device adjusting an angle between a rolling wheel and a bearing wheel.

Refer to FIGS. 2A and 3A. FIG. 3A is a schematic diagram of a sheet metal hemming device 100 adjusting an angle θ between a rolling wheel 120 and a bearing wheel 130. An angle θ is formed between the center line of the rolling wheel 120 and the center line of the bearing wheel 130, and the sheet metal 10 is rolled between the rolling wheel 120 and the bearing wheel 130 to form a hemming side 12. The shape and the angle of the hemming side 12 can be determined according to the angle θ between the rolling wheel 120 and the bearing wheel 130, such that the hemming side 12 of the sheet metal 10 after rolling can have an angle of 0°-90°.

Refer to FIGS. 2A and 2B. The arc-shaped guide rail 162 can have two hollow chutes 163, and the sliding block 160 is correspondingly provided with four positioning rods 161 (represented by dotted lines) passing through the two hollow chutes 163, wherein two positioning rods 161 pass through one hollow chute 163, such that the sliding block 160 can move along the arc-shaped guide rail 162.

In an embodiment, the arc-shaped guide rail 162 can be an arced structure of a ¼ circle whose radius is the length of the first rotating shaft 140 between the sliding block 160 and the rolling wheel 120, and when the sliding block 160 is moved from one end to the other end of the arc-shaped guide rail 162, the angle θ between the rolling wheel 120 and the bearing wheel 130 is increased to 90° from 0°. That is, the angle between the rolling wheel 120 and the bearing wheel 130 is in a range of 0°-90°.

Refer to FIGS. 2A and 2B. In an embodiment, the driver 170 includes a motor 172, a steering structure 174 and a crank 176. The steering structure 174 includes a first rotating member 173 and a second rotating member 175 engaged with the first rotating member 173. The first rotating member 173 is disposed on the shaft of the motor 172, and the crank 176 is connected to one end of the second rotating member 175. When the steering structure 174 rotates, the crank 176 rotates around the second rotating member 175. The crank 176 is connected to a rotating pin 165 of the sliding block 160 via a long slot to transfer the torque of the motor 172 to the sliding block 160, such that the sliding block 160 can move along the arc-shaped guide rail 162. Exemplarily but not restrictively, the steering structure 174 can be a bevel gear set. In FIG. 3A, the controller 180 controls the torque of the motor 172 and the rotation direction of the steering structure 174 to adjust the angle θ between the rolling wheel 120 and the bearing wheel 130.

Figure 3B:
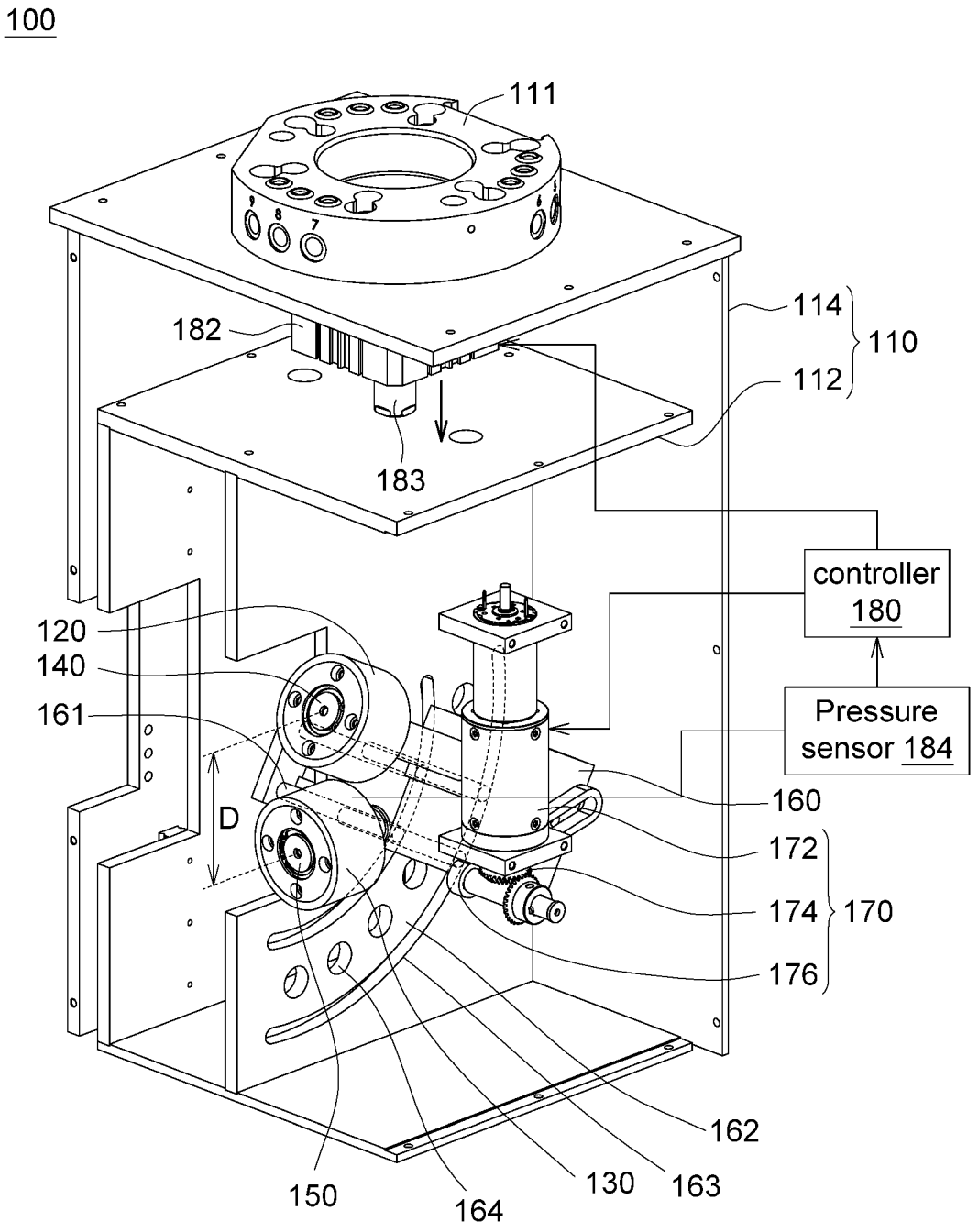
FIG. 3B is a schematic diagram of a sheet metal hemming device adjusting a distance between a rolling wheel and a bearing wheel.

Referring to FIG. 3B, a schematic diagram of a sheet metal hemming device 100 adjusting a distance D between a rolling wheel 120 and a bearing wheel 130 is shown. The frame 110 includes an inner frame 112 and an outer frame 114, and the inner frame 112 is movable up and down relative to the outer frame 114. The rolling wheel 120, the first rotating shaft 140, the sliding block 160, the arc-shaped guide rail 162 and the driver 170 all are disposed on the inner frame 112, and the bearing wheel 130 and the second rotating shaft 150 are disposed on the outer frame 114. Therefore, as the inner frame 112 moves up and down relative to the outer frame 114, the distance D between the rolling wheel 120 and the bearing wheel 130 varies, such that the rolling wheel 120 and the bearing wheel 130 can contact and roll the sheet metal 10.

Additionally, the sheet metal hemming device 100 includes a controller 180, a force generator 182 and a pressure sensor 184. The controller 180 is connected to the force generator 182 and the pressure sensor 184. The force generator 182, such as a hydraulic cylinder or a pneumatic cylinder, is provided with a piston rod 183. The force generator 182 is connected between the inner frame 112 and the outer frame 114, such that the inner frame 112 can move up and down. With the force generator 182, the controller 180 can adjust the distance D between the rolling wheel 120 and the bearing wheel 130, that is, the controller 180 can adjust the contact force applied on the sheet metal 10 between the rolling wheel 120 and the bearing wheel 130. Moreover, the pressure sensor 184 can be disposed on the bearing wheel 130 to detect a sheet metal contact force between the rolling wheel 120 and the bearing wheel 130. With the pressure sensor 184, the controller 180 can adjust the upward/downward movement of the force generator 182 to adjust the distance D between the rolling wheel 120 and the bearing wheel 130.

Figure 4A:
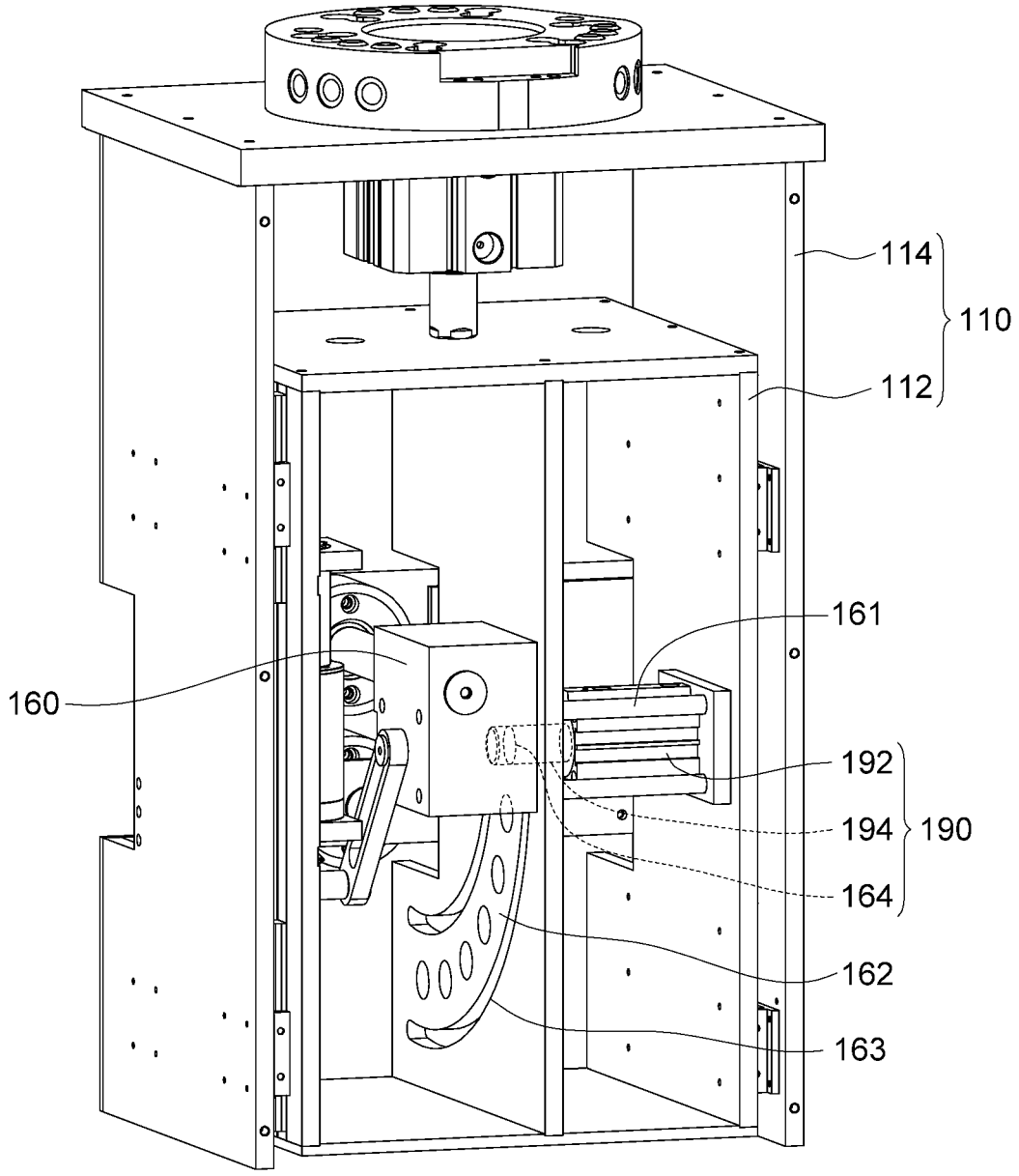
FIG. 4A is a schematic diagram of a brake according to an embodiment of the disclosure.

Refer to FIGS. 3A and 4A. FIG. 4A is a schematic diagram of a brake 190 according to an embodiment of the disclosure. The sheet metal hemming device 100 may further include a brake 190 configured to fix the sliding block 160 at a position on the arc-shaped guide rail 162. The brake 190 is disposed on the sliding block 160 and is controlled by the controller 180 to generate a braking force on the sliding block 160. The brake 190 includes a pressure cylinder 192 (refer to FIG. 4A) and a piston rod 194 (represented by dotted lines as indicated in FIG. 4A) and matches several holes 164 basically disposed at an interval along the arc-shaped guide rail 162. The positions of the holes 164 correspond to the position of the piston rod 194. When the sliding block 160 moves to the hole 164 at a designated position, the pressure cylinder 192 ejects the piston rod 194 to be inserted to the designated hole 164; meanwhile, the sliding block 160 is limited at an angle θ.

Figure 4B:
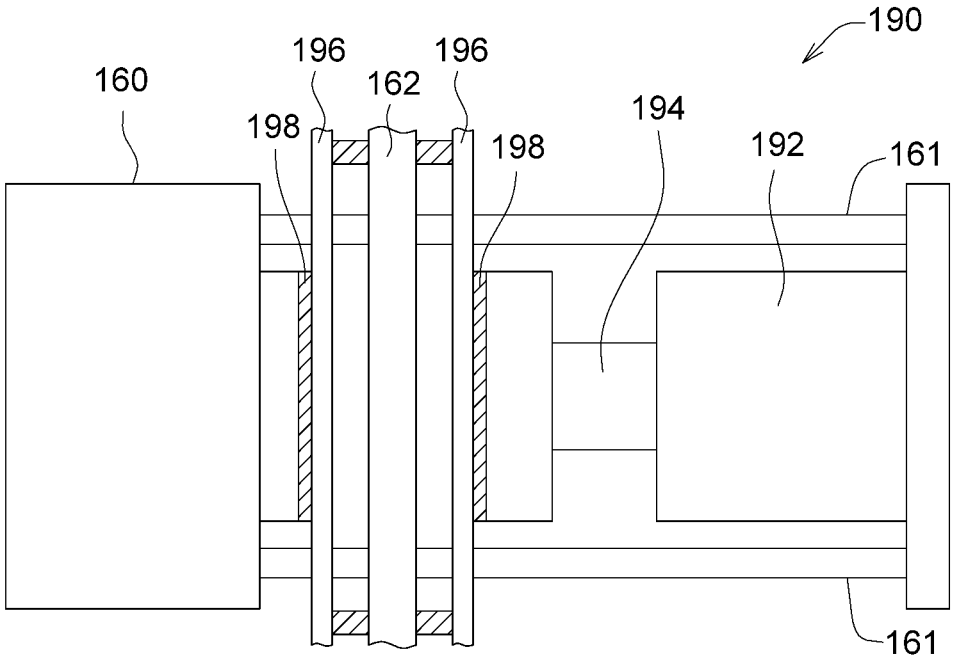
FIGS. 4B and 4C respectively are schematic diagrams of a brake according to another embodiment of the disclosure.
Figure 4C:
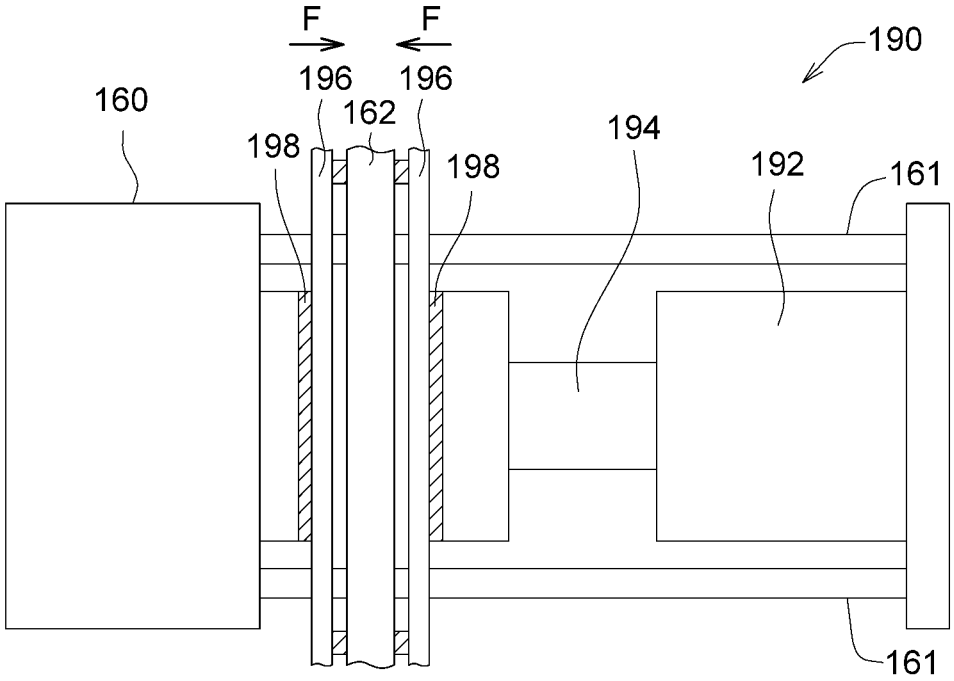

Refer to FIGS. 4B and 4C. In another embodiment, the brake 190 includes a pressure cylinder 192, a piston rod 194, a disc pack 196 and two friction plates 198, wherein the pressure cylinder 192 ejects the piston rod 194 and causes the two friction plates 198 to friction with the disc pack 196 to generate a braking force on the sliding block 160. In an embodiment, the disc pack 196 is fixed at the positioning rod 161 of the sliding block 160 and can move along the arc-shaped guide rail 162, and the two friction plates 198 respectively are disposed on two opposite sides of the disc pack 196. When the sliding block 160 is moved to the designated position, the pressure cylinder 192 drives the two friction plates 198 to clamp the disc pack 196, such that the two friction plates 198 and the disc pack 196 are fixed by the frictional force F, and the disc pack 196, after receiving a force, stops on the arc-shaped guide rail 162. The implementation of the brake 190 is not limited to the disc pack 196 clamped between the two friction plates 198. For example, the two friction plates 198 respectively generate a frictional force on a corresponding disc of the disc pack 196; alternatively, one single friction plate 198, ejected by the piston rod 194, can directly generate a frictional force on the arc-shaped guide rail 162.

As disclosed above embodiments, the sheet metal hemming device of the disclosure can roll a hemming side without using a mold, hence saving the mold cost. Furthermore, the sheet metal hemming device of the disclosure can control the contact force and the hemming angle between the rolling wheel and the sheet metal, increase the flexibility of hemming the sheet metal and increase machining quality through process optimization.

It will be apparent to those skilled in the art that various modifications and variations can be made to the disclosed embodiments. It is intended that the specification and examples be considered as exemplary only, with a true scope of the disclosure being indicated by the following claims and their equivalents.

What is claimed is:

1. A sheet metal hemming device, comprising:

a frame;

a rolling wheel, a bearing wheel, a first rotating shaft, a second rotating shaft, a sliding block, an arc-shaped guide rail and a driver being disposed on the frame; and a brake configured to fix the sliding block on the arc-shaped guide rail;

wherein, the rolling wheel is disposed on the first rotating shaft, the bearing wheel is disposed on the second rotating shaft, and an angle is set between the rolling wheel and the bearing wheel;

the sliding block is slidable relative to the arc-shaped guide rail and is connected to the rolling wheel via the first rotating shaft;

the driver is connected to the sliding block for driving the sliding block to slide along the arc-shaped guide rail to adjust the angle between the rolling wheel and the bearing wheel.

2. The sheet metal hemming device according to claim 1, wherein the arc-shaped guide rail comprises two hollow chutes, and the sliding block is correspondingly provided with a plurality of positioning rods passing through the two hollow chutes.

3. The sheet metal hemming device according to claim 1, wherein the driver comprises a motor, a steering structure and a crank; the motor is connected to the steering structure, the steering structure is connected to the crank, and the crank is connected to the sliding block to transfer the torque of the motor to the sliding block.

4. The sheet metal hemming device according to claim 3, wherein the steering structure is a bevel gear set.

5. The sheet metal hemming device according to claim 1, wherein the frame comprises an inner frame and an outer frame, the inner frame is movable relative to the outer frame, the rolling wheel, the first rotating shaft, the sliding block, the arc-shaped guide rail and the driver are disposed on the inner frame, and the bearing wheel and the second rotating shaft are disposed on the outer frame.

6. The sheet metal hemming device according to claim 5, further comprising a controller and a force generator, wherein the force generator is connected between the inner frame and the outer frame, and the controller drives the force generator to adjust a distance between the rolling wheel and the bearing wheel.

7. The sheet metal hemming device according to claim 6, further comprising a pressure sensor disposed on the bearing wheel, wherein the pressure sensor detects a sheet metal contact force between the rolling wheel and the bearing wheel for the controller to adjust the distance between the rolling wheel and the bearing wheel.

8. The sheet metal hemming device according to claim 1, wherein the brake comprises a pressure cylinder and a piston rod and matches a plurality of holes disposed on the arc-shaped guide rail, the positions of the holes correspond to the position of the piston rod, and when the sliding block is moved to a designated hole, the pressure cylinder ejects the piston rod to be inserted to the designated hole.

9. The sheet metal hemming device according to claim 1, wherein the brake comprises a pressure cylinder, a disc pack and two friction plates; the disc pack is disposed on the sliding block and movable along the arc-shaped guide rail, the two friction plates respectively are disposed on two opposite sides of the disc pack, and when the sliding block is moved to a designated position, the pressure cylinder drives the two friction plates to clamp the disc pack.

* * * * *